US007530783B1

(12) United States Patent
Ediger

(10) Patent No.: US 7,530,783 B1
(45) Date of Patent: May 12, 2009

(54) GRILL MOUNTING AND RETAINING ASSEMBLY

(75) Inventor: Glen Wesley Ediger, North Newton, KS (US)

(73) Assignee: Vornado Air Circulation Systems, Inc., Andover, KS (US)

( * ) Notice: Subject to any disclaimer, the term of this patent is extended or adjusted under 35 U.S.C. 154(b) by 390 days.

(21) Appl. No.: 11/262,414

(22) Filed: Oct. 28, 2005

(51) Int. Cl.
*F04D 29/64* (2006.01)

(52) U.S. Cl. ..... 415/121.2; 415/213.1; 415/214.1; 415/220; 416/247 R

(58) Field of Classification Search ..... 415/121.2, 415/213.1, 214.1, 220; 416/247 R
See application file for complete search history.

(56) References Cited

U.S. PATENT DOCUMENTS

| | | | | |
|---|---|---|---|---|
| 1,871,625 | A | 8/1932 | Luff | |
| 2,554,601 | A * | 5/1951 | Sutton | 415/182.1 |
| 2,640,646 | A * | 6/1953 | Jones | 415/211.2 |
| 3,963,382 | A | 6/1976 | Patton | |
| 4,353,680 | A * | 10/1982 | Hiraoka et al. | 415/222 |
| 4,657,483 | A | 4/1987 | Bede | |
| 4,927,324 | A | 5/1990 | Coup et al. | |
| 5,073,088 | A | 12/1991 | Peng | |
| RE34,551 | E | 2/1994 | Coup et al. | |
| 5,348,447 | A | 9/1994 | Redetzke | |
| 5,352,094 | A | 10/1994 | Peng | |
| 5,868,127 | A | 2/1999 | Chiang et al. | |
| 6,036,444 | A | 3/2000 | Barney et al. | |
| 6,045,330 | A | 4/2000 | Williams | |
| 6,071,078 | A * | 6/2000 | Schlegel et al. | 416/247 R |
| 6,213,718 | B1 | 4/2001 | Hill et al. | |
| 6,364,618 | B1 | 4/2002 | Moreno | |

* cited by examiner

*Primary Examiner*—Igor Kershteyn
(74) *Attorney, Agent, or Firm*—Stinson Morrison Hecker LLP

(57) ABSTRACT

An assembly for securely mounting and retaining a protective grill onto an appliance housing, comprising fasteners secured to the appliance housing and corresponding prongs extending from the protective grill wherein the grill may be removably mounted to the appliance housing by inserting the free end of the prong into an aperture in the fastener, whereby spring tension resiliently urges a portion of the fastener toward the opening over which the grill is mounted and around the prongs.

15 Claims, 7 Drawing Sheets

50
52
55
70
51

66
70
51
55
52
53
58
54

51
52
51
55
58
53

51
58

55
51
54
53
58

66

GRILL MOUNTING AND RETAINING ASSEMBLY

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention relates generally to the field of fans and similar appliances having a guard or grill to prevent unintended access to certain working components of the appliance, and is more specifically directed to a grill retaining assembly for securely attaching or mounting a protective grill to a portable fan to prevent excessive vibration and accidental displacement of the grill during operation.

2. Description of Related Art

Portable fans utilize rotating blades to produce air movement. Typically, these fans include protective grills that permit substantially unimpeded air flow while preventing potentially injurious physical contact with the rotating fan blades. For ease of manufacturing, shipping and storage, protective grills are often discrete assemblies removably attachable to the fan unit.

While rotating fan blades can cause injury to persons coming into physical contact with the blades, access to the fan blades is desired for proper maintenance, cleaning and repair of the operating unit. Accordingly, protective grills have been employed in the industry to prevent accidental contact with the fan blades, while still allowing maintenance access. A reliable means for securely attaching the protective grill to the fan is necessary. The retaining means should be simple and economical to manufacture and simple to operate while at the same time meeting applicable safety regulations. The retaining means must also be constructed such that accidental access to the fan blades or access by children will not occur. It is also desirable that the protective grill be sufficiently secured to the fan so as to minimize noise and vibration of the grill during operation of the unit.

BRIEF SUMMARY OF THE INVENTION

The present application is directed to a mounting assembly for removably mounting a guard or grill to a fan body. The mounting assembly comprises a prong extending radially outward along the outer perimeter of the grill and a fastener extending inward from the fan body adjacent the perimeter of the opening over which the grill is to be mounted. The grill may be removably mounted to the fan body over the opening by inserting the free end of the prong into an aperture in the fastener. The free end of the prong extends through the fastener in the same plane as that of the grill and the fastener extends essentially transverse the plane of the grill. In this manner, movement of the prong is prevented by contact between a side of the prong and a side of the fastener containing the aperture. The fastener preferably comprises a leaf spring or otherwise is constructed or configured to resiliently urge that portion of the fastener having the aperture toward the interior of the opening—toward the central fan hub—over which the grill will be mounted.

In a preferred embodiment, a plurality of prongs are integrally formed with the grill as extensions of the vanes of the grill. The grill comprises a plurality of vanes extending radially outward from a central hub, wherein the tail end of each vane forms a prong. In this embodiment, the vanes extend radially outward from a central hub of the grill wherein the tail of the vanes is bent rearward of the grill along the perimeter of the grill so as to extend essentially transverse the plane of the grill (in the Y-plane). The free end of the tail is bent at an approximate right angle from the rearward extending portion of the tail to extend outwardly from the grill at an angle approximately perpendicular to the fastener and in the same plane as the grill. Thus, the tail of the vane is essentially L-shaped extending rearward and outward from the grill. The grill is configured to fit over an opening formed by the fan body. The fan body has an inner wall that defines the opening, and a fastener is secured or mounted to the inner wall. The fastener conforms substantially to the shape of the inner wall of the fan body. The fastener includes an aperture and is mounted to the inner wall such that the portion of the fastener containing the aperture extends essentially transverse the fan grill to be mounted over the opening and has a leaf spring characteristic that urges the fastener and aperture inwardly into the opening and toward the center of the fan interior.

In a most preferred embodiment, the surface of the fastener facing the opening includes a groove that serves to guide the free end of the prong into the aperture and serves to cradle the rearward extending portion of the tail of the vane. The fastener is preferably a relatively planar U-shaped strip having an inner end section, a U-shaped central section and an outer end section. The inner end section is secured within the interior of the fan body. The U-shaped section extends through an opening in the inner wall of the fan body, such that the U-shaped portion is located substantially within the interior of the fan body and the outer end section extends along the perimeter of the opening over which the grill will be mounted and retained.

DETAILED DESCRIPTION OF PREFERRED EMBODIMENT

Figure 1:
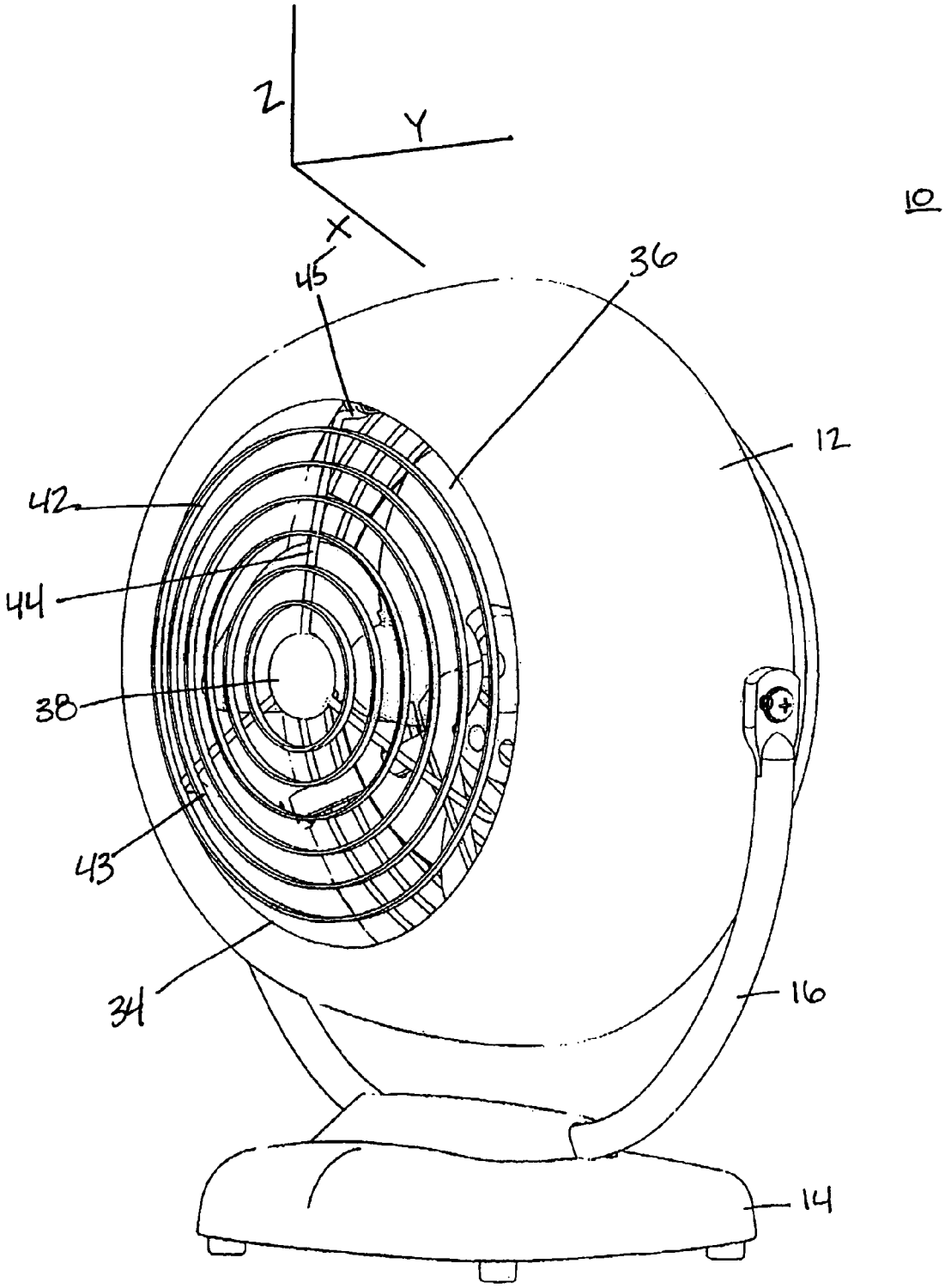
FIG. 1 is a front perspective view, with planar references, of a portable fan utilizing a mounting assembly in accordance with one embodiment of the present invention.

Referring first to FIGS. 1-4, there is shown an electric fan unit in accordance with the present invention generally referred to by reference numeral 10. Fan unit 10 comprises fan housing 12 pivotally mounted to base 14. Fan housing 12 defines annular opening 34 over which protective grill 42 is fitted and retained by prong 45 and fastener 50, as explained in more detail below.

Figure 2:
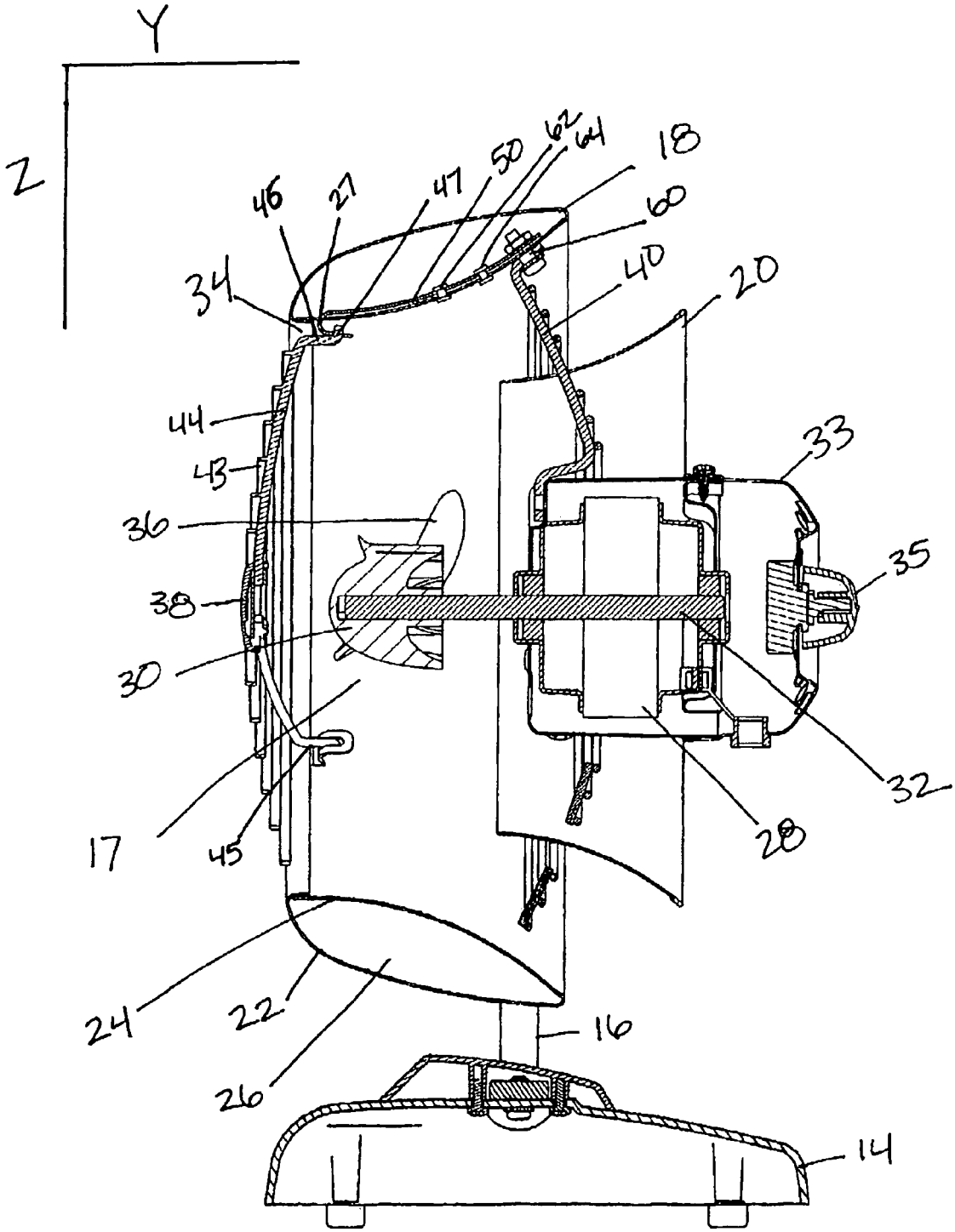
FIG. 2 is a cut away side view, with planar references, of the fan of FIG. 1.

Fan housing 12 is mounted to base 14 by yoke 16. Yoke 16 can be secured in any manner, including screws or other means known in the art. In this manner, fan housing 12 may be tilted upward or downward with respect to yoke 16. Fan housing 12 comprises cowl 18 and guide cone 20 positioned rearwardly in spaced relation to cowl 18. Cowl 18 is preferably formed by uniting outer shell 22, which is generally concave in shape, and inner shell 24, which is generally convex in shape, to create inner space therebetween 26. As shown in FIG. 2, space 26 is preferably elliptical in shape. Fan motor 28 surrounded by motor housing 33, is positioned within guide cone 20, and carries impeller assembly 30 extending forward of motor 28 via drive shaft 32. Impeller assembly 30 preferably has three fan blades 36*a*, 36*b*, 36*c* extending from central hub 38 and is positioned within annular opening 34 defined by cowl 18. Protective grill 42 is mounted over the front of opening 34 to prevent accidental physical contact with impeller assembly 30 via the mounting assembly of the present invention. As more fully described hereinafter, the mounting assembly comprises a plurality of prongs 45 extending from the perimeter of grill 42 and corresponding fasteners 50 secured along inner cowl member 24.

Figure 3:
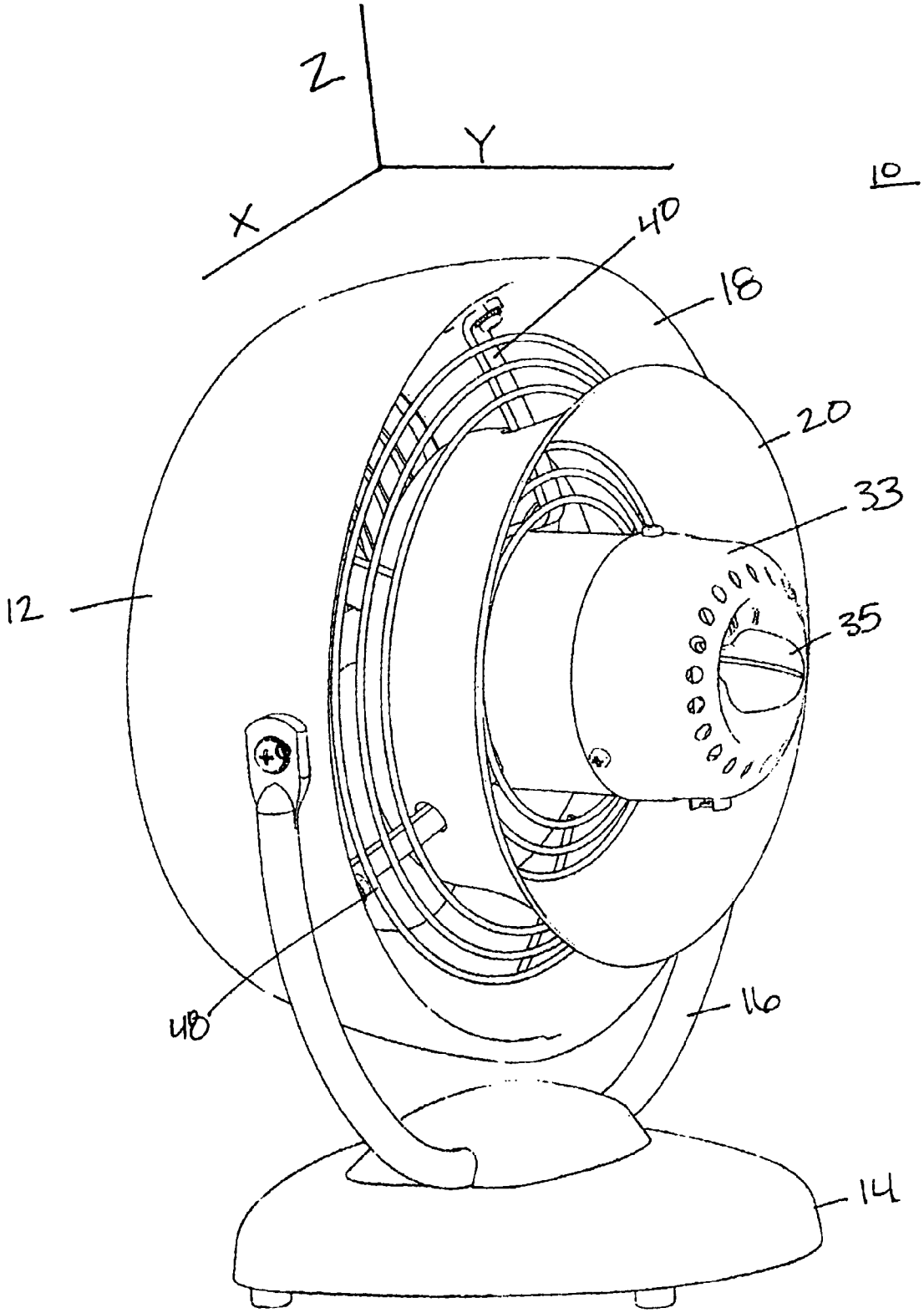
FIG. 3 is a rear perspective view, with planar references, of the fan of FIG. 1.

As generally known in the art and as shown in FIGS. 1-4, fan motor 28 carries an impeller assembly 30 on its drive shaft 32 that preferably includes three fan blades 36*a*, 36*b*, 36*c*. Impeller assembly 30 is located within opening 34 defined by cowl 18. Fan motor 28 is concentrically bolted to motor housing 33 by bolt assemblies. As shown in FIGS. 2 and 3, motor housing 33 is preferably a plastic injection molded part, although motor housing 33 could also be metal. Motor housing 33 and guide cone 20 are preferably securely attached to cowl 18 by a plurality of support straps 40, preferably three in number, extending radially between impeller assembly 30 and inner cowl member 24. The support straps 40 are preferably secured to impeller assembly 30 and inner cowl member 24 by means of nut and bolt assemblies.

As shown in FIGS. 2 and 3, rear grill 48 extends between cowl 18 and guide cone 20, and between guide cone 20 and motor housing 33. Rear grill 48 is preferably formed by annular metal rings which are welded or otherwise secured to support straps 40. It is also within the scope of the invention for fan unit 10 not to have rear grill 48 or for rear grill 48 to be of any other construction generally known in the art. Fan unit 10 preferably includes electric cord (not shown) to supply power to fan unit 10, as well as power switch 35 to initiate operation of fan unit 10. In operation, impeller 30 draws air axially through spaces between the cowl 18 and guide cone 20 and between the guide cone 20 and motor housing 33, and projects air forward though the front of the opening 34 and grill 42.

Although a preferred embodiment of a fan unit 10 has been heretofore described, it should be noted that the present invention may be utilized with virtually any fan configuration, provided the fan utilizes a separate protective grill to protect the impeller assembly, which protective grill is desired to be removably secured to the fan housing or fan unit. It should be understood that the present invention may be utilized in conjunction with various constructions and configurations of fans or other appliances having a main body, an opening and a protective guard or grill to be mounted to the main body over the opening. Thus, the present invention is not limited to the specific type and configuration of fan illustrated in the drawings which are for exemplary purposes only. Any variety of fan or other appliances known in the art may be used in conjunction with the mounting assembly of the present invention. Similarly, the specific shape of the opening 34 in the appliance may be of any shape other than annular, such as hexagonal and the like and the appliance body may be of any general shape. Examples of standard constructed fans on which the mounting assembly may be used include, without limitation, those sold under the brand names Vornado®, Holmes®, Hunter®, Honeywell®, and Soleus®.

Figure 4:
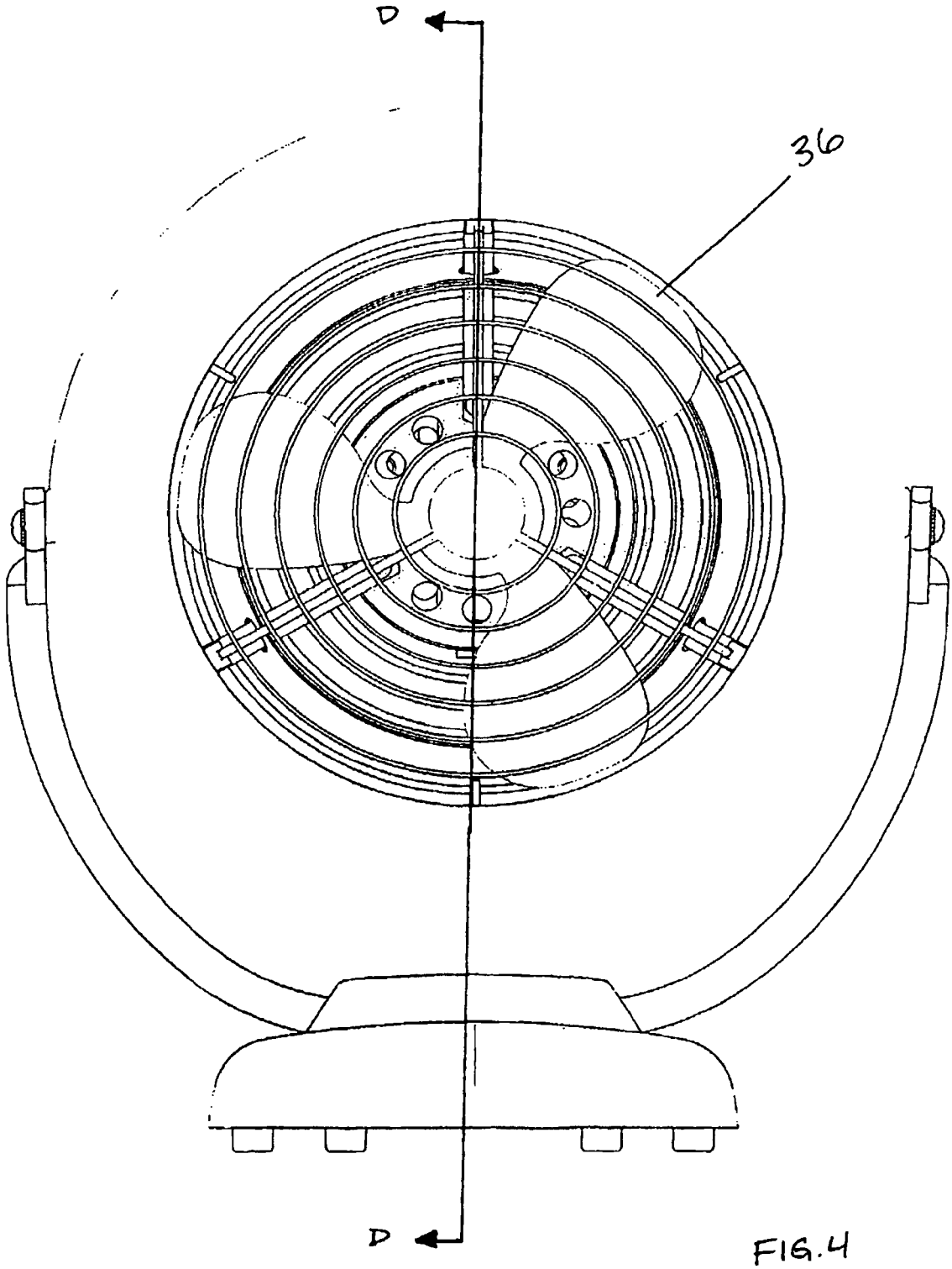
FIG. 4 a front view of the fan of FIG. 1, showing the perspective cut-away line D-D.

The present invention is directed to a mounting assembly for mounting and retaining a protective grill 42 over an opening 34 in a fan or other appliance, and to a portable fan comprising such a mounting assembly. In the preferred embodiment shown in the drawings, protective grill 42 is located at the front of fan housing 12, as shown in FIGS. 1, 2 and 4. Protective grill 42 preferably comprises multiple annular rings 43 connected by radially extending vanes 44. Vanes 44 extend outwardly towards the exterior of fan housing 12 and terminate in prongs 45. In the embodiment depicted, protective grill 42 includes three radially extending vanes 44 which are welded to annular rings 43. Of course, it should be noted that any number of vanes 44 above one is sufficient provided protective grill 42 is adequately supported. It should also be understood that means of securely attaching vanes 44 to protective grill 42, other than welding, are also within the scope of the present invention.

Figure 5:
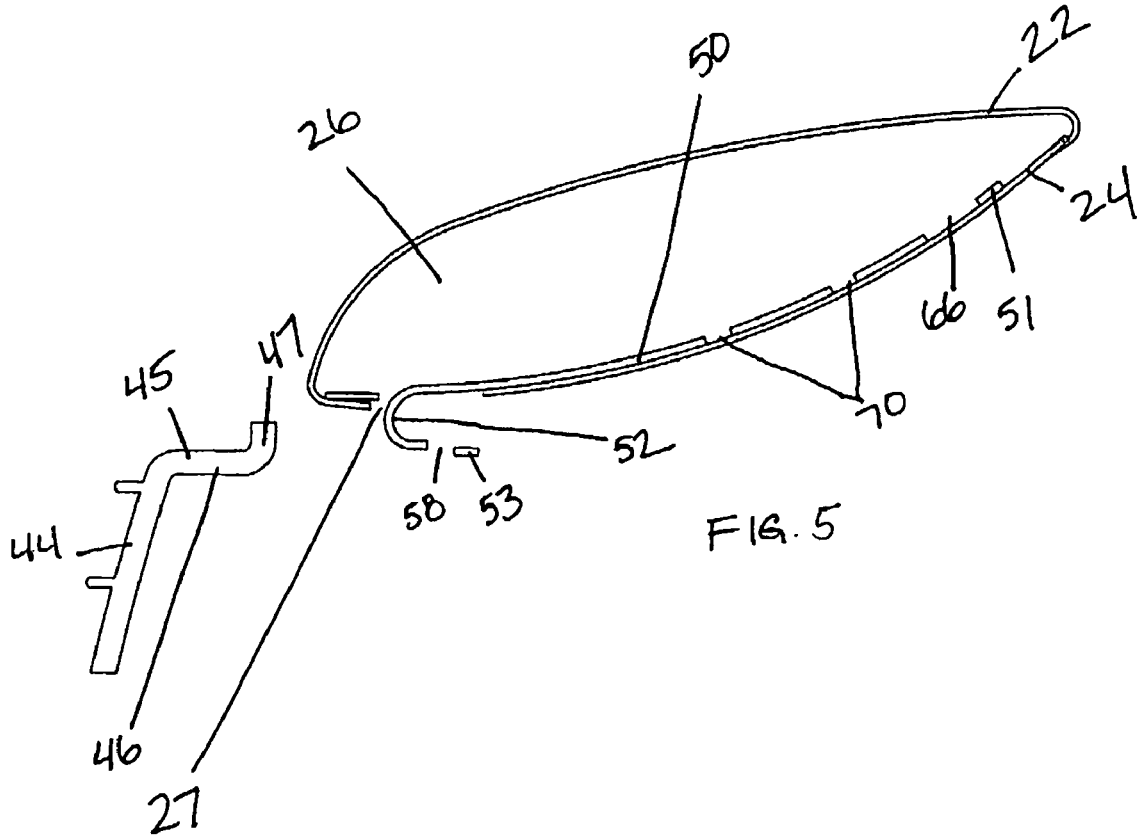
FIG. 5 is an enlarged cut away side view of the cowl of the fan of FIG. 1 taken along line [D-D] showing the prong separate from the fastener.
Figure 6:
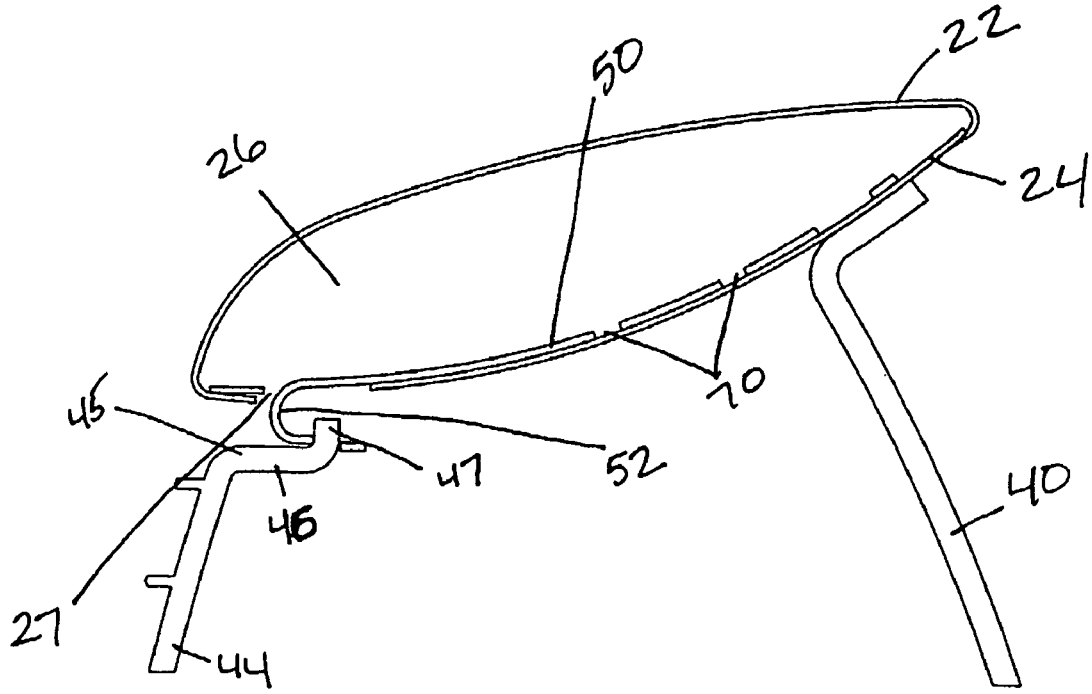
FIG. 6 is an enlarged cut away side view of the cowl of the fan of FIG. 1 taken along line [D-D] showing the free end of the prong fitted within the aperture of the fastener.

In a preferred embodiment, a plurality of prongs 45 are integrally formed with grill 42 as extensions of vanes 44. Grill 42 comprises a plurality of vanes 44 extending radially outward from central hub 38 wherein the tail end of each vane forms prong 45. In this embodiment, vanes 44 extend radially outward from central hub 38 of grill 42. As shown in FIGS. 2, 5 and 6, a rearward portion of the prong 46 is bent rearward of grill 42 along the perimeter of grill 42 so as to extend essentially transverse the plane of the grill (in the Y-plane) and in the same general plane as fastener 50 described hereafter. Rearward portion 46 extends at an angle relative to the Z-plane. This angle is preferably at least 45 degrees and more preferably is approximately 90 degrees. Free end of vane 47 is bent outward toward the inner wall of fan housing 12, preferably at an angle of at least 45 degrees and more preferably at an approximate 90 degree angle from the rearward extending portion of vane 46. Free end 47 extends outwardly from grill 42 and in the same general plane as grill 42. Thus, as shown in FIGS. 2, 5 and 6, prongs are essentially L-shaped where prongs 45 extend rearward and outward from grill 42. As described in more detail below, free end 47 extends through fastener 50 in the same plane as that of grill 42 such that when in place, movement of prong 45 is prevented by contact between the tail end of prong 46 and fastener 50.

The free end of prong 45 end is shaped and sized to fit snugly within fastener aperture 58 in second end of fastener 53. Prong 45 may optionally include a slot or other indention (not shown) such that it may be retained within fastener aperture 58 by detent means. Prongs 45 are preferably resilient, yet flexible such that prongs 45 may be physically pushed inward or outward with respect to fan housing 12 or cowl 18. Protective grill 42, vanes 44 and prongs 45 are preferably made of metal, although a durable plastic material may also be used. Vanes 44 and prongs 45 are preferably circular in cross-sectional shape, for ease of manufacturing, although other shapes are well within the scope of the present invention. For instance, ellipsoid, rectangular or other cross-sectional shapes are within the scope of the present invention.

It should be noted that other specific configurations of protective grills 42 may be utilized within the scope of the present invention, provided prongs 45 or some other similar means of finger-like projections which can engage fastener 50 as described below are present. For example, annular rings 43 are not necessary for operation of the present invention, and a grill 42 utilizing multiple radially extending vanes 44 without any annular rings would fall within the scope of the present invention. Similarly, honeycomb or grate configurations—to name a few—are also within the scope of the invention, provided the grill 42 comprises prongs 45 or other similar structure which may be secured within fastener 50 as hereinafter described, utilizing spring tension to retain the protective grill 42 onto the fan housing 12.

Protective grill 42 is secured to fan housing 12 and retained thereon preferably by at least two, and more preferably by three, retaining fasteners 50. Fastener 50 is preferably shaped to compliment the shape of inner cowl member 24. Fastener 50 is preferably juxtaposed interior surface of inner cowl member 24, within open area 26 created by inner cowl member 24 and outer cowl member 22. As shown in FIGS. 2 and 5-8, fastener 50 is preferably of a very slight convex longitudinal shape. Fastener 50 extends along interior of inner cowl member 24 adjacent the perimeter of opening 34 over which grill 42 is to be mounted. Fastener 50 includes aperture 58 and is mounted to the interior wall such that the portion of the fastener containing the aperture 58 extends essentially transverse the fan grill 42 to be mounted over the opening 34 and has a leaf spring characteristic that urges the fastener 50 and aperture 58 inwardly through the opening 34 and toward the center of the fan interior.

Figures 7, 8, 9, 10, 11, 12:
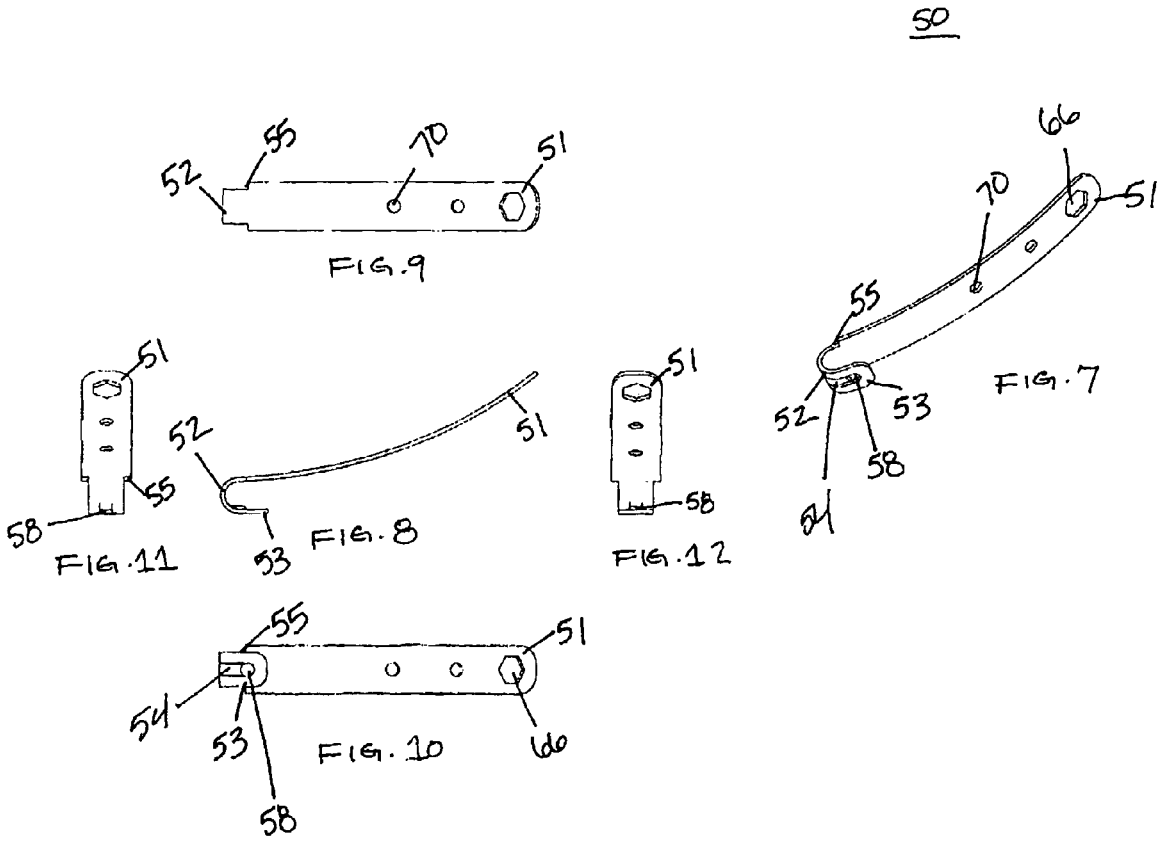
FIG. 7 is a perspective view of the fastener of the present invention.
FIG. 8 is a side view of the fastener of FIG. 7.
FIG. 9 is a top view of the fastener of FIG. 7.
FIG. 10 is a bottom view of the fastener of FIG. 7.
FIG. 11 is a top perspective view of the fastener of FIG. 7.
FIG. 12 is a bottom perspective view of the fastener of FIG. 7.

As shown in FIGS. 2, 5-12, fastener 50 comprises first inner end 51 and second outer end 53. First end of fastener 51 is secured to fan housing 12, and preferably to the interior wall of inner cowl member 24. First end of fastener 51 preferably has at least one aperture 66 for receiving a nut and bolt assembly 60 to secure fastener 50 to inner cowl member 24 or housing 12. Nut and bolt assembly 60 further preferably extends through support strap 40 to secure rear grill 48 to fan housing 12. As shown in FIGS. 9 though 12, aperture 66 is preferably hexagonal in shape to accommodate nut and bolt assembly 60, although other shapes such as circular or square to name a few, are adequate to receive nut and bolt assembly 60. Additional apertures 70 may be present in first end 51 for use during manufacture of fan unit 10. Additional apertures 70 in first end 51 enable fastener 50 to be secured to cowl 18 or fan housing 12 with rivets 62, 64 or the like during production for added stability as shown in FIGS. 5 through 12. Additional apertures 70 are preferably circular in shape for ease of manufacturing. Inner cowl member 24 comprises apertures (not shown in FIGS. 5 and 6) corresponding to fastener 50 apertures such that nut and bolt assembly 60 and rivets 62, 64 may pass through both fastener 50 and inner cowl member 24.

If fan unit 10 does not include inner cowl member 24, fastener 50 is preferably shaped to compliment the shape of fan housing 12 to which it abuts. In such case, fastener 50 is preferably juxtaposed the interior surface of fan housing 12. Fastener 50 comprises a strip of material and is preferably metal, although a durable yet flexible plastic material may also be used. Fastener 50 operates as a spring tension member. As shown in FIGS. 5 through 12, side-to-side profile of fastener 50 is generally planar. Ends of fastener 50 are preferably rounded for safety purposes so that there are no sharp edges present, although shapes other than rounded are within the scope of the present invention. While three fasteners 50 are preferred to secure protective grill 42 to fan housing 12, more than three fasteners 50 could also be utilized. If more than three fasteners 50 are utilized, fasteners 50 are preferably spaced equi-distant apart for stability.

Inner cowl member 24 includes an aperture 27 in fluid communication with the impeller assembly cavity 17. As shown in FIGS. 2, 5 and 6, second outer end 53 of the fastener partially extends through aperture 27, near the front of fan housing 12, into the opening or cavity 17. Second end 53 is removably attached to protective grill 42. A central U-shaped curve 52 extends between the first and second ends and comprises an approximate 180-degree curve. Curved portion 52 extending through opening 27 in the interior wall of the fan housing 12, such that curved portion 52 is located substantially within the interior of the fan housing 12 and within the space 34 over which the grill 42 will be mounted and retained. Curved portion 52 is preferably U-shaped and comprises an approximate 180 degree angle. The width of second end of fastener 53 is preferably slightly narrower than the width of first end 51, creating a shoulder portion 55. Shoulder portion 55 allows second end 53 to pass through aperture 27, while providing stability to the remaining portion of fastener 50 and ensuring fastener 50 does not extend too far into impeller assembly cavity 17. Although preferable, shoulder 55 is not necessary to proper functioning of the present invention.

The second end 53 of fastener 50 includes an aperture 58 for receiving the free end of prong 45. Fastener aperture 58 is shaped and sized to securely receive prong 45. While it is preferable that the shape of fastener aperture 58 compliment that of prong 45 cross-section, exact duplication is not required.

Housing aperture 27 is preferably a rectangular slot, but could be other shapes as long as it accommodates curve 52 and second end of fastener 53 and allows for slight movement of fastener 50 as a result of vibration as well as for movement necessary to engage and disengage prong 45 from fastener 50. In a most preferred embodiment, the interior facing surface of second end 53 comprises groove 54 that serves to guide the free end of the prong 47 into aperture 58 and serves to cradle the rearward extending portion 46 of vane. As shown in FIGS. 2 and 6, rearward portion 46 of vane abuts second end 53 and prong 45 rests in recessed groove 54 to assist and maintain insertion of the free end of prong 45 in fastener aperture 58. Other means of maintaining the insertion depth of prong 45 are also within the scope of the present invention. As shown in FIG. 2, the free end of prong 45 passes completely through aperture 58 and is circumferentially surrounded thereby.

Although recessed groove 54 is preferable in order to direct prong 45 into fastener aperture 58, groove 54 is not necessary and it is within the scope of the present invention to utilize fastener 50 with fastener aperture 58 only and with no groove 54. Fastener 50 is preferably one single piece of material, although it is possible that first end of fastener 51 and second end of fastener 53 will be made of separate pieces of material securely connected to each other by means of a weld, rivets, or other attachment.

In operation, depicted in FIGS. 5 and 6, fastener 50 (and more specifically, second end of fastener 53) is pushed outward away from fan interior such that the free end of prong 45 may slide into groove 54 and is directed into aperture 58 and retained securely therein by means of tension. Fastener 50 is then released and prong 45 is thereby secured within aperture 58. In a preferred embodiment, this operation is repeated three times such that the three prongs 45 are secured into the three corresponding spring tension fasteners 50, thereby retaining protective grill 42 onto fan housing 20. Prongs 45 are dislodged from fasteners 45 and protective grill 42 is removed from fan housing 12 by physically moving each fastener 50 radially outward while pushing prong 45 inward to disengage prong 45 from fastener aperture 58. Grill 42 may then be removed in a controlled fashion by pulling grill 42 forward with the free end of prong 47 riding in the recessed groove 54 of fastener 50. In this manner, two physical movements are required to disengage prong 45 from fastener 50; namely pushing the fastener 50 outward while pushing the prong 45 inward and forward. In the alternative, a special tool, such as a flat-head screwdriver, or the like, may be used to disengage prongs 45 and remove protective grill 42. The head of the screwdriver is inserted between prong 45 and second end of fastener 53. Second end of fastener 53 is physically pushed toward the exterior of fan housing 12. The end of prong 45 will slide out of fastener aperture 58 and recessed groove 54 for disengagement. As discussed above, if recessed grooves 54 are not utilized, prong 45 will disengage from fastener aperture 58 only. Once all prongs 45 are disengaged from fasteners 50, protective grill 42 may be easily removed from fan housing 12. If fan unit 10 does not include inner cowl member 24 and/or outer cowl member 22, fastener 50 may be physically moved towards exterior of fan housing 12, such that the invention operates in the same way as described above, wherein fan housing 12 contains opening 27 through which fastener 50 extends.

From the foregoing it will be seen that this invention is one well adapted to attain all ends and objectives herein-above set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and sub-combinations are of utility and may be employed without reference to other features and sub-combinations. This is contemplated by and is within the scope of the claims.

What is claimed and desired to be secured by Letters Patent is as follows:

1. A mounting assembly for mounting a protective grill onto an appliance body, comprising:

an appliance body, defining an opening;

at least one fastener extending from said appliance body in a first plane, wherein said fastener comprises a recessed longitudinal groove and an aperture located in said first plane, wherein said fastener is secured to said appliance body in a manner to resiliently urge said fastener into said opening;

a protective grill located in a second plane, configured to be mounted to said appliance body over said opening; and at least one prong extending from said grill, wherein said prong is configured to be received within said recessed longitudinal groove and inserted through said aperture at an angle relative to said first plane of said fastener.

2. The assembly of claim 1, wherein said prong comprises a first rearward extending portion extending rearward of said grill at an angle relative to said grill and a free end extending outward from a perimeter of said grill at an angle relative to said first rearward extending portion.

3. The assembly of claim 1, wherein a free end of said prong configured to be inserted through said aperture lies in the same plane as said grill.

4. The assembly of claim 2, wherein said first rearward extending portion extends rearward of said grill at an angle between approximately 45 and 90 degrees.

5. The assembly of claim 4, wherein said first rearward extending portion extends rearward of said grill at an angle of approximately 90 degrees.

6. The assembly of claim 2, wherein said free end extends outward from said perimeter of said grill at an angle between approximately 45 and 90 degrees.

7. The assembly of claim 6, wherein said free end extends outward from said perimeter of said grill at an angle of approximately 90 degrees.

8. The assembly of claim 1, wherein said fastener is formed of a single piece of material.

9. The assembly of claim 1, wherein said fastener is made of metal.

10. The assembly of claim 1, wherein said fastener is made of molded plastic.

11. An assembly for retaining a protective fan blade grill onto a fan unit, comprising:

at least three strips, each of said at least three strips having first and second opposing ends and having a contoured portion extending from said first end of strip to the beginning of said second end of strip, said contoured portion formed to compliment the fan housing to which it abuts;

said first end of said at least three strips each secured to said fan housing; and said second end of said at least three strips each forming a curved, tension spring portion of said at least three strips, comprising an approximate 180 degree curve and having an aperture and a longitudinal groove for receiving a portion of a fan unit protective grill, said second end of strip extending through an aperture in said fan housing into the interior cavity created by said fan housing.

12. The assembly of claim 11, wherein said portion of said protective grill received by said second end of said at least three strips comprises two approximate right angle bends oriented such that a free end of said protective grill portion may be inserted into said aperture of second end of strip and retained therein by means of tension.

13. An assembly for retaining a protective fan blade grill onto a fan unit, comprising:

a fan housing, comprising an inner and an outer cowl member, said housing creating a cavity for retaining the operational workings of a fan inside said cavity;

a protective fan blade grill comprising three L-shaped extensions protruding outwardly;

three retaining strips, each of said strips having a U-shaped mid-section with first and second opposing ends, wherein said first end of each of said retaining strips is securely fastened to said inner cowl member, each of said retaining strips contoured to compliment a shape of said inner cowl;

each of said U-shaped mid-sections extending through an opening in said inner cowl and into said fan housing cavity;

each of said second ends having an aperture for receiving a corresponding extension of said protective fan blade grill, and having a recessed longitudinal groove for directing said extension of said protective fan blade grill into said aperture; and wherein said protective grill is retained onto said fan housing by means of tension.

14. A method of retaining a protective fan blade grill onto a fan unit, comprising the steps of:

moving a tension spring secured to a fan unit radially outward, wherein said tension spring comprises a bend of between approximately 90 and 180 degrees, forming a curved end;

sliding an extension of a protective grill through a groove located in said curved end of said tension spring; and inserting said extension of said protective grill into an aperture located in said curved end of said tension spring.

15. A method of retaining a protective fan blade grill onto a fan unit, comprising the steps of:

allowing radially outward movement of a tension spring secured to a fan unit;

allowing an extension of a protective grill to slide through a groove located in a curved end of said tension spring;

allowing said extension of said protective grill to be inserted into an aperture located in a curved end of said tension spring; and wherein said curved end comprises a bend of between approximately 90 and 180 degrees.

* * * * *